US006431400B1

(12) United States Patent
O'Maley et al.

(10) Patent No.: US 6,431,400 B1
(45) Date of Patent: Aug. 13, 2002

(54) DISPENSER APPARATUS THAT CONTROLS THE TYPE AND BRAND OF THE PRODUCT DISPENSED THEREFROM

(75) Inventors: James B. O'Maley, Lighthouse Pt.; Francis J. Parker, Cooper City; Alan Levy, Delray Beach, all of FL (US)

(73) Assignee: UltraClenz Engineering Group, Riviera Beach, FL (US)

( * ) Notice: Subject to any disclaimer, the term of this patent is extended or adjusted under 35 U.S.C. 154(b) by 0 days.

(21) Appl. No.: 09/531,789

(22) Filed: Mar. 21, 2000

(51) Int. Cl.[7] ..... B67D 5/00

(52) U.S. Cl. ..... 222/41; 222/154; 222/325; 222/333; 141/94; 141/367; 141/386; 141/DIG. 1

(58) Field of Search ..... 222/41, 47, 49, 222/50, 154, 182, 185.1, 538, 539, 325, 333, 372, 378, 382, 405; 141/94, 346, 367, 383, 386, DIG. 1

(56) References Cited

U.S. PATENT DOCUMENTS

| | | | | | |
|---|---|---|---|---|---|
| 4,280,638 | A | | 7/1981 | Keihm | 222/180 |
| 4,615,476 | A | | 10/1986 | Hobbs et al. | 222/153 |
| 4,651,902 | A | | 3/1987 | Hobbs et al. | 222/153 |
| 4,673,109 | A | | 6/1987 | Cassia | 222/153 |
| 4,886,192 | A | | 12/1989 | Cassia | 222/181 |
| 5,186,360 | A | | 2/1993 | Mease et al. | 222/63 |
| 5,209,377 | A | | 5/1993 | Steiner et al. | 222/189 |
| 5,255,822 | A | | 10/1993 | Mease et al. | 222/63 |
| 5,312,017 | A | * | 5/1994 | Schroeder et al. | 222/23 |
| 5,344,047 | A | | 9/1994 | Chen | 222/63 |
| 5,464,125 | A | | 11/1995 | Daansen | 222/156 |
| 5,492,247 | A | | 2/1996 | Shu et al. | 222/63 |
| 5,501,372 | A | | 3/1996 | Daansen | 222/207 |
| 5,507,413 | A | | 4/1996 | Chen | 222/63 |
| 5,598,952 | A | | 2/1997 | Daansen | 222/105 |
| 5,605,251 | A | * | 2/1997 | Retti | 222/325 |
| 5,613,625 | A | | 3/1997 | Specht | 222/180 |
| 5,738,153 | A | * | 4/1998 | Gerling et al. | 141/94 |
| 5,875,921 | A | * | 3/1999 | Osgar et al. | 222/383.1 |
| 5,992,698 | A | | 11/1999 | Copeland et al. | 222/180 |

* cited by examiner

*Primary Examiner*—J. Casimer Jacyna
(74) *Attorney, Agent, or Firm*—Jay H. Maioli

(57) ABSTRACT

A dispenser apparatus for controlling the type and brand of a product dispensed therefrom, so that only authorized products are dispensed from the apparatus. A container inserted into a housing case stores the product, the container having an exit port. A chute directs the flow of the discharged product. A drive assembly causes the product to move from the container through the chute to be dispensed therefrom. A magnetic sensor is attached to a support surface of the housing case, and a wafer is attached to the container. The wafer has a magnet embedded therein, and the container is inserted into the housing case so that the wafer is received by and mates with the housing case to align the magnet with the magnetic sensor. A location of the magnet embedded in the wafer of the container is detected by the magnetic sensor of the housing case so that the container is identified. The drive means is only activated when the container is identified as an authorized container based on the location of the magnet.

16 Claims, 6 Drawing Sheets

DISPENSER APPARATUS THAT CONTROLS THE TYPE AND BRAND OF THE PRODUCT DISPENSED THEREFROM

FIELD OF THE INVENTION

The present invention relates to the field of dispensing units and more particularly, to a dispenser apparatus wherein the type and brand of the product dispensed therefrom can be identified, and certain types and brands can be restricted from use within the dispensing apparatus.

BACKGROUND OF THE INVENTION

Dispenser units are common in everyday life and dispense many different types of products. The dispensed products may range from liquid to solid substances, and the dispensers may be found in a variety of different environments. The products may include antimicrobial soap, antibacterial soap, lotion, and medicinal products. One typical use for a dispenser unit is to supply hand soap to a user of a public restroom.

Typically, dispenser units are supplied to a number of various customers by the cleaning product supplier. The supplier may want to have the capability of controlling the type of dispensed product that is installed in the dispenser unit. In addition, the supplier may desire to control the brand of the dispensed product that is installed in the dispenser unit. In this way, the customer is able to place certain restrictions on the dispensed product and thereby is able ultimately to prevent the person who uses the dispenser unit from using an unauthorized or incorrect product. For example, the customer or the supplier may want to prevent the dispensing unit from being filled with a type of soap that is not suitable for the needs of the user. Or the supplier may want to prevent the dispensing unit from being filled with a brand of soap from a distributor that is a competitor of the supplier.

Existing dispensing units attempt to provide the customer with the capability to distinguish between the different types of products dispensed therefrom. These existing dispensing units, however, suffer from problems relating to production cost, efficiency, and the difficulty of adapting to accommodate different permissible types of products.

For example, some existing dispensing units are mechanical designs that feature cartridges with grooves therein that fit together with corresponding ribs located on a mounting bracket of the dispenser unit. The corresponding groove and rib assembly prevents the use of improper products in the dispensing unit because the grooves and ribs must fit together, or else the cartridge will not fit into its proper position in the mounting bracket. Altering the rib and groove assembly, however, in order to accommodate different permissible cartridges is troublesome because the size and configuration of the ribs and grooves must be physically varied. This necessitates a reconfiguration of not only the entire cartridge structure, but the structure of the mounting bracket as well. Other designs use a similar "mating" technique, such as a bottle with a specially contoured neck portion. Consequently, there is a need for a simpler design that allows different types of cartridges to be accepted without having to change the entire structure of the dispensing unit and cartridge assembly.

OBJECTS AND SUMMARY OF THE INVENTION

It is an object of the current invention to solve the problems discussed above relating to previously known dispensing units.

Specifically, it is an object of the current invention to provide a dispensing unit that controls the type of dispensed product that may be installed therein.

It is also an object of the current invention to provide a dispensing unit that controls the brand of the dispensed product that is installed therein.

The current invention provides a supplier with the capability to place certain restrictions on the dispensed product and to thereby ultimately prevent the user from using an unauthorized product.

According to one aspect of the present invention, a dispenser apparatus is provided wherein the type and brand of the product dispensed therefrom can be identified, and certain types and brands can be restricted from use within the dispensing apparatus. The present invention incorporates a simple design that allows different types of cartridges to be accepted without having to change the entire structure of the dispensing unit and cartridge assembly.

One embodiment of the present invention relates to a dispenser apparatus for dispensing a product therefrom, comprising: a housing case; a container inserted into the housing case for storing the product, the container having an exit port from which the product is discharged; drive means for causing the product to be discharged from the container through the exit port; a magnetic sensor attached to a support surface of the housing case; a wafer attached to an annular disk that encircles the exit portion of the container and having a magnet embedded therein, wherein the container is inserted into the housing case so that the wafer is received by and mates with the housing case to align the magnet with the magnetic sensor; wherein a location of the magnet embedded in the wafer of the container is detected by the magnetic sensor of the housing case so that the container is identified; and wherein the drive means is only activated when the container is identified as an authorized container based on the proper location of the magnet. The wafer has two cut-off edge portions to form two straight edges that fit into the housing case. The drive means may comprise a motor and a pump, or a flexible discharge tube that emits the product from the nozzle when the flexible discharge tube is compressed.

Another embodiment of the present invention relates to a dispenser apparatus for dispensing a product therefrom, comprising: a housing case; a container inserted into the housing case for storing the product, the container having a neck portion; a nozzle attached to the housing case for emitting the product therefrom; a hose portion for connecting the container to the nozzle or chute; drive means for causing the product to move from the container through the hose portion and out the nozzle; resistance measuring means attached to a support surface of the housing case; a wafer attached to the container and having a resistor element embedded therein, wherein the container is inserted into the housing case so that the wafer is received by and mates with the housing case to electrically connect the resistor element to the resistance measuring means; wherein a resistance value of the resistor element embedded in the wafer of the container is measured by the resistance measuring means of the housing case so that the container is identified; and wherein the drive means is only activated when the container is identified as an authorized container based on the resistance value of the resistor element.

Another embodiment uses the idea of resistance measurement also. Here, however, the resistive element is the dispensing tube itself. A tube made of electronically conductive rubber is used in place of the bag disk containing a resistive element. Electrical connections are made using conventional contacts engaging the tube but preferably would be made with pointed metal contacts which would penetrate the exterior surface of the tube. Penetration of the tube has the advantage of preventing corrosion of the tips of the contacts due to spillage of the dispensed material. The tubes are made with a specific resistance value corresponding with each product to be identified.

Another embodiment of the present invention relates to a dispenser apparatus for dispensing a product therefrom, comprising: a housing case; a container inserted into the housing case for storing the product, the container having an exit port; a nozzle attached to the housing case for emitting the product therefrom; a hose or chute portion for directing flow of the discharged product from the exit port; drive means for causing the product to move from the container through the hose or chute portion; a first inductive coil attached to a support surface of the housing case; a wafer attached to the container and having a second inductive coil embedded therein and a capacitor connected to the second inductive coil, wherein the container is inserted into the housing case so that the wafer is received by and mates with the housing case; wherein a resonant frequency is established by the capacitor so that the container is identified; and wherein the drive means is only activated when the container is identified as an authorized container based on the resonant frequency.

Another embodiment of the present invention relates to a dispenser apparatus for dispensing a product therefrom, comprising: a housing case; a container inserted into the housing case for storing the product, the container having an exit port; a nozzle attached to the housing case for emitting the product therefrom; a hose or chute portion for directing flow of the discharged product from the exit port out the nozzle; drive means for causing the product to move from the container through the hose or chute portion to be dispensed therefrom; a first magnet-sensor pair attached to a support surface of the housing case and containing a first magnet and a corresponding first sensor; a second magnet-sensor pair attached to the support surface of the housing case and containing a second magnet and a corresponding second sensor; a wafer attached to the container and having an iron or other magnetic element embedded therein to route magnetic flux from the first magnet to the first sensor while the second sensor is inactive, wherein the container is inserted into the housing case so that the wafer is received by and mates with the housing case; logic means for detecting when each sensor is activated; wherein the drive means is only activated when the first sensor is activated to identify the container as an authorized container.

Another embodiment of the present invention relates to a dispenser apparatus for dispensing a product therefrom, comprising: a housing case; a container inserted into the housing case for storing the product, the container having an exit port; a nozzle attached to the housing case for emitting the product therefrom; a hose or chute portion for directing flow of the discharged product from the exit port out the nozzle; drive means for causing the product to move from the container through the hose or chute portion; a plurality of sensors attached to a support surface of the housing case and being electrically connected to binary decoder means; a wafer attached to the container and having a plurality of magnets placed thereon, wherein the plurality of magnets and the plurality of sensors are arranged to provide a binary code to be fed to the binary decoder means, and wherein the container is inserted into the housing case so that the wafer is received by and mates with the housing case; wherein the binary code is identified by the binary decoder means of the housing case; and wherein the drive means is only activated when the binary code is identified as an authorized binary code.

Another embodiment of the present invention relates to a dispenser apparatus for dispensing a product therefrom, comprising a housing case; a container inserted into the housing case for storing the product, the container having a neck portion and having a chute portion made of conductive rubber; a nozzle attached to the chute portion for emitting the product therefrom; drive means for causing the product to move from the container through the chute portion and out the nozzle; resistance measuring means attached to a support surface of the housing case;

wherein a resistance value of the chute portion is measured by the resistance measuring means of the housing case so that the container is identified; and wherein the drive means is only activated when the container is identified as an authorized container based on the resistance value of the chute portion.

Another embodiment of the present invention relates to a dispenser apparatus for dispensing a product therefrom, comprising a housing case; a container inserted into the housing case for storing the product, the container having an exit port; a chute to direct flow of the product from the exit port; drive means for causing the product to move from the container through the chute to be dispensed therefrom; a light emitting diode attached to a support surface of the housing case; a photoelectric sensor attached to the support surface of the housing case;

a wafer attached to the container and having a plurality of photosensors located thereon;

wherein light is conducted from the light emitting diode to the photoelectric sensor so that a location of the photosensors on said wafer of the container is identified; and wherein the drive means is only activated when the container is identified as an authorized container based on the location of the plurality of photosensors.

DETAILED DESCRIPTION OF THE INVENTION

Figure 1:
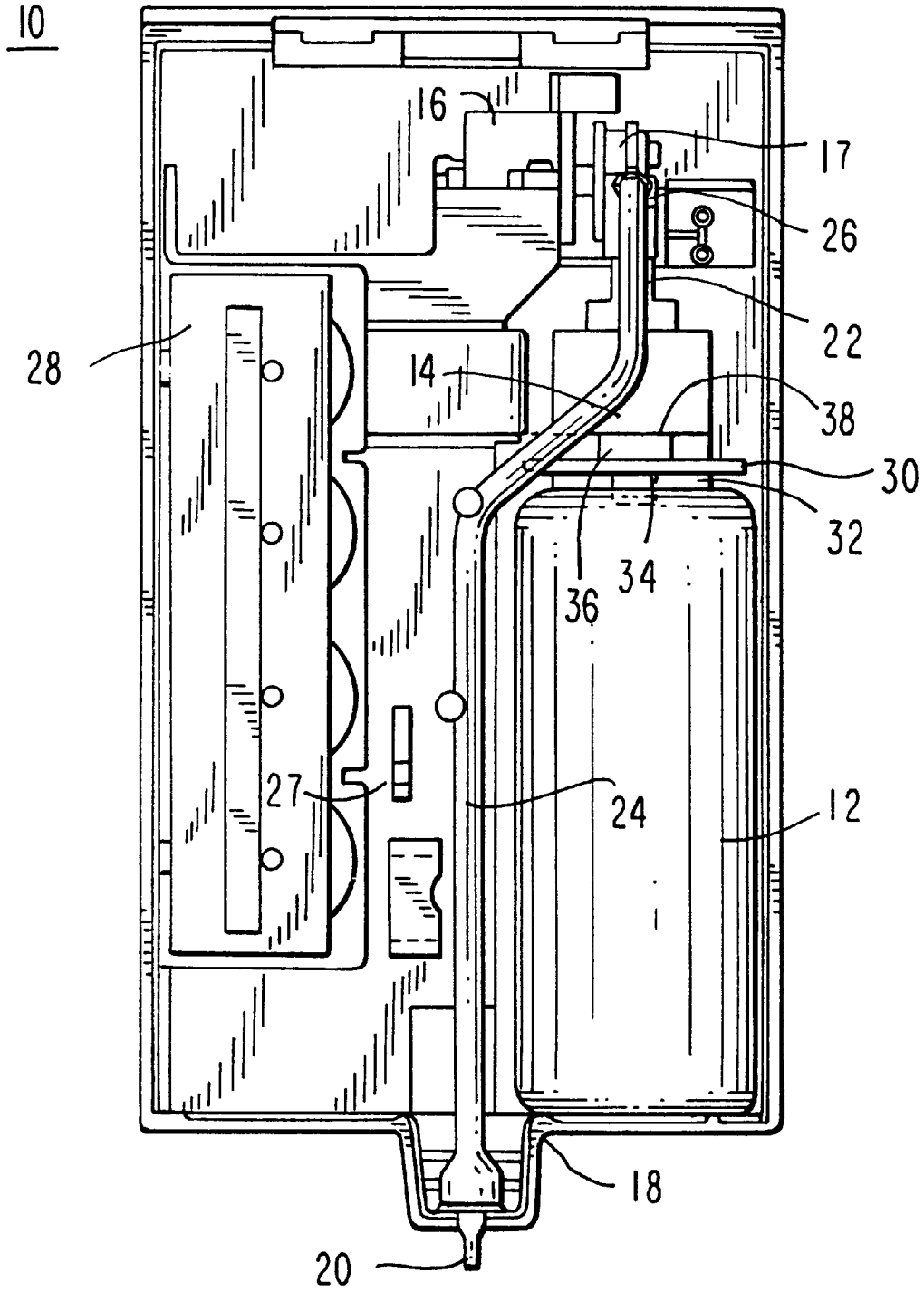
FIG. 1 shows a first embodiment of the dispenser apparatus according to the present invention.

Referring to FIG. 1, a first embodiment of a dispenser unit according to the present invention is shown. Although this embodiment relates to an apparatus that dispenses a liquid substance, it is to be understood that the present invention is not limited thereto, and therefore may dispense many different types of products. For example, powder products may be dispensed therefrom. Furthermore, although this embodiment relates to a "touch free" or automatic dispensing unit, it is likewise to be understood that the present invention is not limited thereto and, therefore, many different types of dispensing units may be employed including, for example, a manually operated "push type" dispensing unit.

FIG. 1 shows the interior of a dispensing unit 10 that uses a bottle 12 containing the liquid to be dispensed. The dispensing unit 10 incorporates a pump 14 driven by a motor 16 and cam 17 assembly for actuating the dispensing operation when a user places his or her hands underneath, if it is determined that the bottle is of the type and brand approved by the supplier. An infrared emitter-detector 18 senses when a user places his or her hands underneath the nozzle 20 and operates within one second thereafter. Upon actuation of the dispensing operation, the dispensed liquid moves from the bottle 12 through the pump 14 and the pump stem 22 and enters the hose 24 by way of the hose top 26. The dispensing unit will automatically reset after the user's hand has been removed for one second. The quantity switch 27 allows the user to set the number of desired dispensing cycles. The entire dispensing unit is powered by batteries housed in a battery cartridge 28.

The means for identifying the particular brand or type of the dispensed product according to the current invention is as follows. A wafer 30 is attached to an annular plastic disk at the base of the neck 32 of the bottle 12. A magnet 34 is embedded in the wafer 30. The encoding means to identify each type or brand is provided by varying the location of the magnet 34.

The wafer 30 with the magnet 34 embedded therein is a disk having cut-off edge portions. The bottle 12 is installed in the dispensing unit 10 by sliding the straight edges of the wafer 30 into the housing case of the dispenser unit 10 so that the wafer is received by and mates with the housing case to ensure that the magnet 34 is properly received. A magnetic sensor 36 is installed on the supporting surface 38 of the dispensing unit 10 adjacent to the disk so that the magnetic sensor 36 is directly above the magnet 34. The magnetic sensor 36 inhibits operation of the dispenser unit 10 unless a properly placed magnet activates the magnetic sensor 36. Examples of a magnetic sensor 36 that may be used include a Hall effect device, such as the Allegro 3210 series, and a reed switch sensor.

By constructing the present invention in the above-described way, when changing the type or brand of product that may be dispensed therefrom, only the location of the magnet 34 needs to be changed. Therefore, it is not necessary to change the entire structure of the bottle 12 and dispensing unit 10 in order to distinguish between different bottles.

Figure 2:
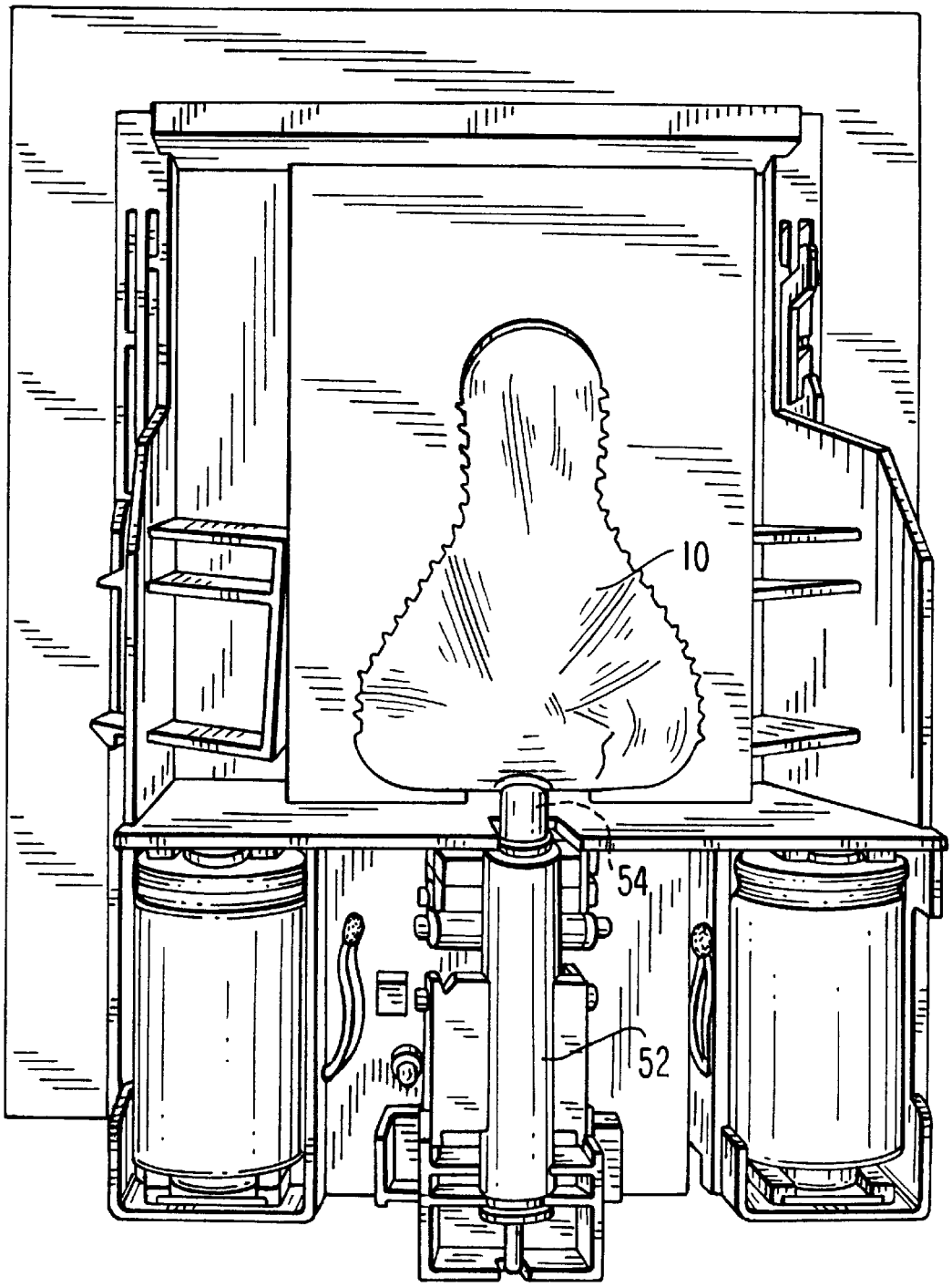
FIG. 2 shows a second embodiment of the dispenser apparatus according to the present invention.
Figure 3:
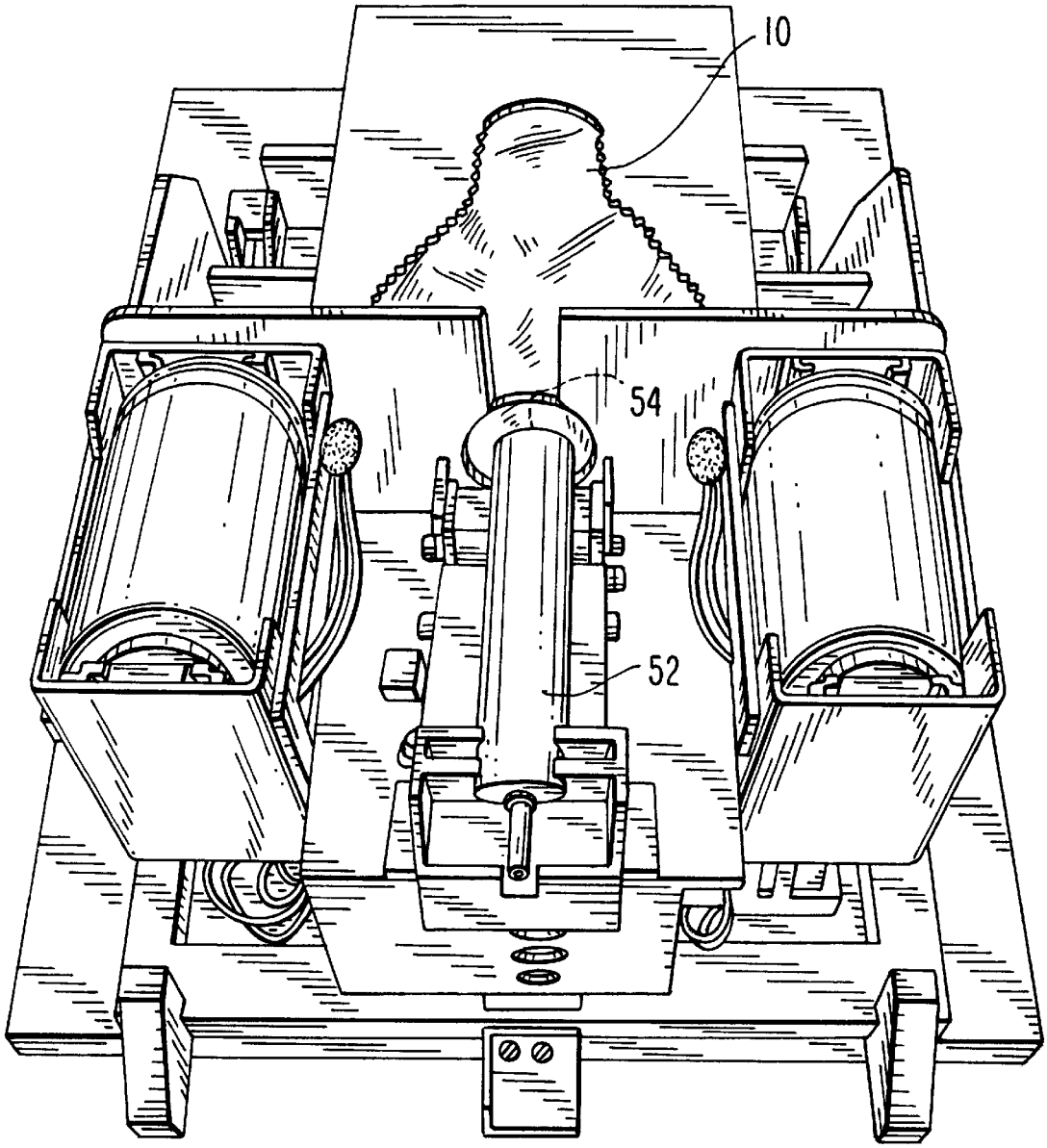
FIG. 3 shows another view of the second embodiment shown in FIG. 2.

It is to be understood that the structure of the dispenser apparatus is not limited to that shown in FIG. 1, and the present invention can be implemented in other structures as well. For example, FIGS. 2 and 3 show a second embodiment of the dispenser apparatus. FIG. 2 is a front view of the dispenser apparatus, showing the bag 10 with chute 52 affixed to exit port 54. FIG. 3 shows the dispenser apparatus of FIG. 2 viewed from below. Further details of the second embodiment are described with reference to FIGS. 4 and 5.

Figure 4:
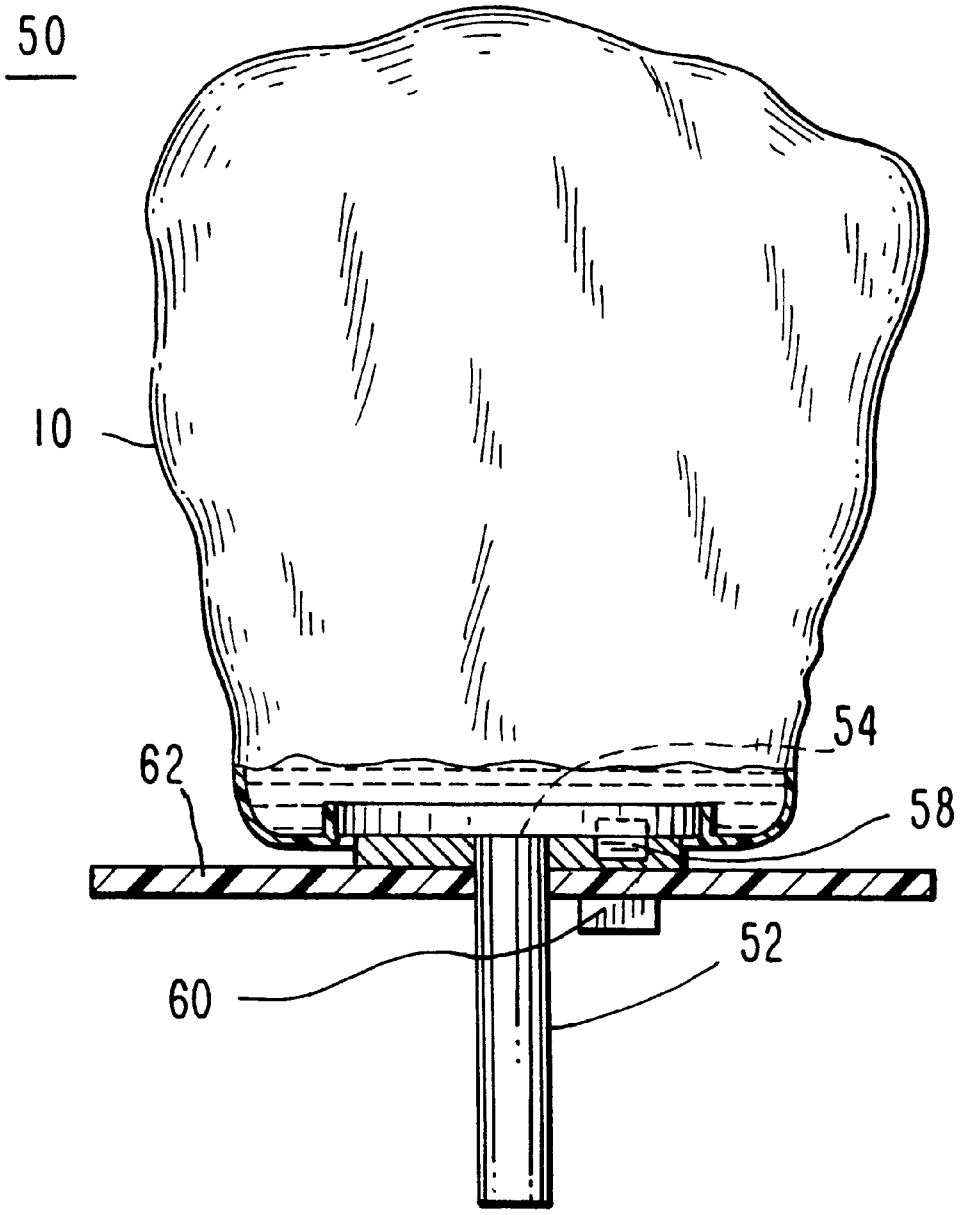
FIG. 4 shows a bag for use in a second embodiment of the dispenser apparatus according to the present invention.
Figure 5:
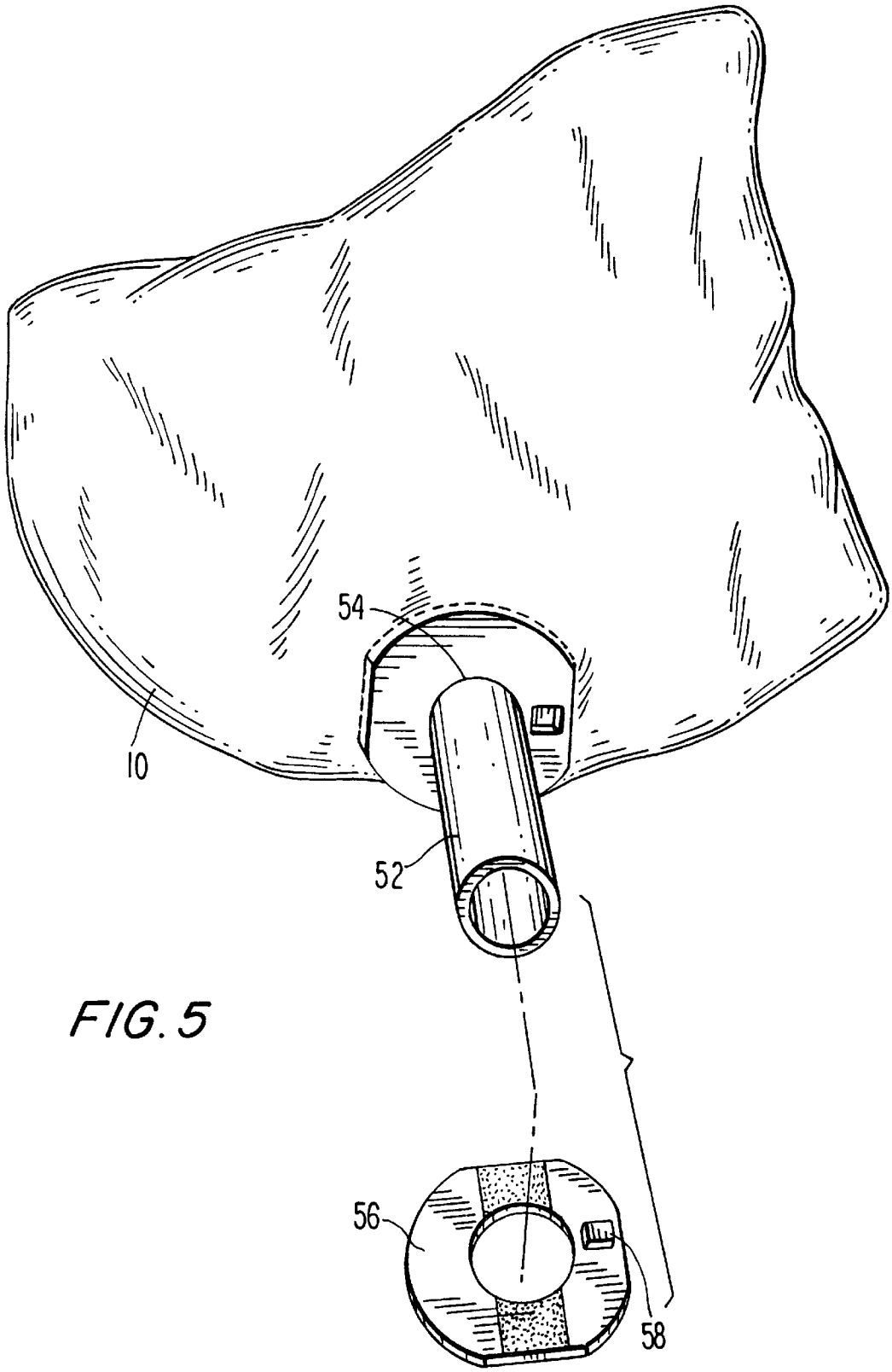
FIG. 5 shows a bag for use in the second embodiment of FIG. 4.

FIG. 4 shows a bag for use in the second embodiment of the dispenser unit of the current invention. The following description of the bag of FIG. 4 relates to a bag containing liquid soap. It is to be understood, however, that the present invention is not limited thereto, and as such many different types of products could be contained in the bag or other container. FIG. 5 also shows the bag of liquid soap.

In this embodiment, rather than having a pump assembly as in the first embodiment, a chute or rubber discharge tube 52 dispenses the liquid soap contained in the bag upon compression of the tube 52. The chute or rubber discharge tube 52 contains two check valves. The first check valve is located at the bag discharge port and operates to prevent "back flow" of the dispensed product. The second check valve allows the liquid soap in the rubber discharge tube to discharge upon compression of the tube 52. The dispenser unit according to the present invention operates only with the desired type or brand of soap bag installed. The means for identifying a particular type or brand of bag-packaged soap according to the second embodiment of the current invention will now be explained.

The bag 50 of FIG. 4 is positioned upside down and the chute or flexible discharge tube 52 is affixed to a port 54 at the neck of the bag 50. A wafer 56 is attached to an annular plastic disk at the base of the port 54. A small magnet 58 is embedded in the wafer 56. The encoding means to individuate each type or brand is provided by varying the location of the magnet 58 of the apparatus.

The wafer 56 with the magnet 58 embedded therein is a disk having cut-off edge portions. The soap bag 50 is installed in the dispensing unit by sliding the straight edges of the wafer 56 into the housing case of the dispensing unit to ensure proper registration of the magnet 58. A magnetic sensor 60 is installed on the bag-supporting surface 62 adjacent to the disk so that the magnetic sensor 60 is directly beneath the magnet. The magnetic sensor 60 inhibits operation of the dispenser unit unless a properly placed magnet activates the magnetic sensor 60. Examples of a magnetic sensor that may be used include, as discussed above, a Hall effect device and a reed switch sensor.

By constructing the present invention in the above-described way, when changing the type or brand of product that may be dispensed therefrom, only the location of the magnet 58 on the soap bag 50 and sensor 36 need be changed. Therefore, it is not necessary to change the entire structure of the soap bag 50 and its corresponding dispensing unit in order to distinguish between different bags.

In a third embodiment of the present invention, two magnet-sensor pairs are installed in the dispenser bag-support surface and are activated by a corresponding iron or other magnetic element located in the bag disk. The magnetic element routes the magnetic flux from one magnet to its mating sensor, while the second sensor remains inactive. In this embodiment, two magnet- sensor pairs are required so that a single disk of magnetic material cannot be used to activate the unit regardless of the location of the elements. Specifically, a logic circuit prevents this result by sensing the state in which only the designated sensor is activated. If both sensors are activated, the circuit is inhibited. Therefore, using two magnet-sensor pairs results in improved counterfeit security.

Figure 6:
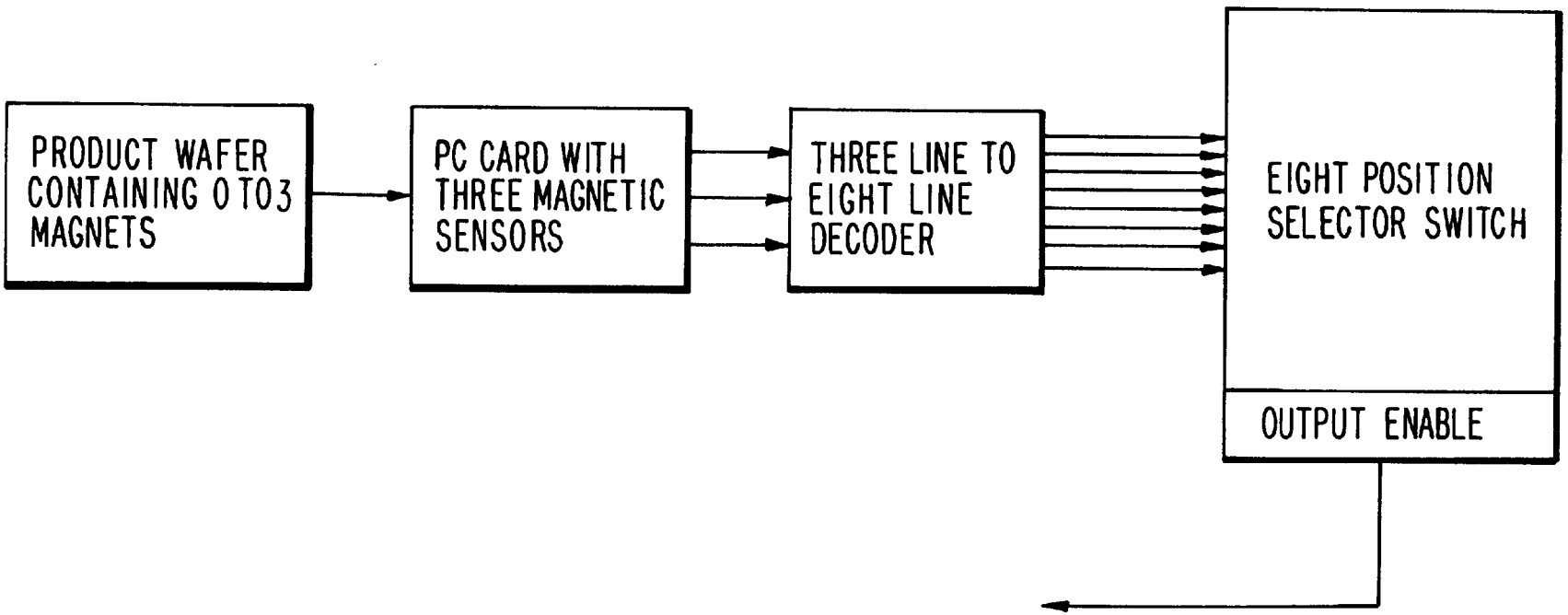
FIG. 6 shows another embodiment of the present invention.

In a fourth embodiment of the present invention, two or more Hall effect sensors are mounted on a printed circuit card which is attached to a support surface of the housing case. A wafer containing one or more embedded magnets is attached to the bag disk. The sensors are electrically connected to a binary decoder device or circuit. For example, three sensor elements and a maximum of three magnets can produce up to eight binary codes. The codes can be decoded by a three line to eight line decoder integrated circuit as shown in FIG. 6. The magnet wafer is arranged with three recessed circular depressions designed to accept up to three small cylindrical magnets. Proper registration of the magnet locations with respect to the sensors is assured as described earlier. Dispensing operation is enabled only for the binary code selected by the eight position switch.

In a fifth embodiment of the present invention, devices other than magnetic devices are used to effect identification based on the location of the sensor elements. In the fifth embodiment, photosensors using fiber optics in the bag wafer conduct light from a light-emitting diode (LED) located at the base-supporting surface to a photoelectric sensor located on the base-supporting surface. The location of the photosensors identify the type or brand of the soap bag.

In a sixth embodiment of the present invention, a resistor element is embedded in the bag wafer. Electrical contacts are then used to connect the resistor element to a circuit located on the bag-supporting surface of the dispensing unit. The circuit is designed to measure the resistance of the embedded element. The type or brand of the bag is then identified based on the individual resistance value of the embedded element. Therefore, it is not necessary to change the structure of the bag and dispensing unit at all in order to allow the use of different bags, because the bags will be distinguished based on the resistance value of the resistor element initially placed thereon and the authorized resistance values can be easily changed.

Alternatively, the resistive element is the dispensing tube itself. A tube made of electrically conductive rubber is used in place of the bag disk containing a resistive element. Electrical connections are made using conventional contacts engaging the tube, but are preferably made with pointed metal contacts which penetrate the exterior surface of the tube. Penetration of the tube has the advantage of preventing corrosion of the tips of the contacts due to spillage of the dispensed material. The tubes are made with a specific resistance value corresponding with each product to be identified.

In a seventh embodiment of the present invention, a resistance measuring device that does not require electrical contacts is used. The device is made with capacitive coupling means to a resistor embedded in the bag disk. Evaluation of the resistance provides the identification means to determine whether the bag is of an accepted brand.

In an eighth embodiment of the present invention, an inductive coupling means is incorporated using a spiral coil located on a printed circuit wafer on the bag which is inductively coupled to a similar spiral coil on the base-supporting surface. A capacitor connected to the spiral coil on the bag establishes a resonant frequency for a conventional frequency-measuring circuit to provide the necessary identification.

Therefore, the present invention provides a cost-effective and simple design that allows different types of cartridges to be accepted without having to change the entire structure of the dispensing unit and cartridge assembly.

The above invention has been described with specific embodiments, but a person skilled in the art could introduce many variations on these embodiments without departing from the spirit of the disclosure or from the scope of the appended claims. The embodiments are presented for the purpose of illustration only and should not be read as limiting the invention or its application. Therefore, the claims should be interpreted commensurate with the spirit and scope of the invention.

We claim:

1. A dispenser apparatus for dispensing a product therefrom, comprising:

a housing case;

a container inserted into said housing case for storing said product, said container having an exit port;

a chute to direct flow of the product from said exit port;

drive means for causing said product to move from said container through said chute to be dispensed therefrom;

a magnetic sensor attached to a support surface of said housing case; and a wafer attached to said container and having a magnet embedded therein, wherein said container is inserted into said housing case so that said wafer is received by and mates with the housing case to align said magnet with said magnetic sensor, wherein a location of said magnet embedded in said wafer of said container is detected by said magnetic sensor of said housing case so that said container is identified, and wherein said drive means is only activated when said container is identified as an authorized container based on a location of said magnet sensor corresponding with the location of said magnet embedded in said wafer attached to said container.

2. The dispenser apparatus as set forth in claim 1, wherein said wafer attached to said container has two cut-off edge portions to form two straight edges that fit into the housing case.

3. The dispenser apparatus as set forth in claim 1, wherein said drive means comprises a motor and a pump.

4. The dispenser apparatus as set forth in claim 1, wherein said drive means comprises a flexible discharge tube that emits the product from the nozzle when the flexible discharge tube is compressed.

5. A dispenser apparatus for dispensing a product therefrom, comprising:

a housing case;

a container inserted into said housing case for storing said product, said container having an exit port;

a chute to direct flow of said product from said exit port;

drive means for causing said product to move from said container through said chute to be dispensed therefrom;

detector means attached to a support surface of said housing case; and a wafer attached to said container and having detectable means embedded therein, wherein said container is inserted into said housing case so that said wafer is received by and mates with said housing case, wherein said detectable means embedded in said wafer of said container is detected by said detector means of said housing case so that said container is identified, and wherein said drive means is only activated when said container is identified as an authorized container based on a result of the detection of said detectable means embedded in said wafer attached to said container.

6. The dispenser apparatus as set forth in claim 5, wherein said detector means includes resistance measuring means, wherein said wafer has a resistor element embedded therein, wherein said container is inserted into said housing case so that said wafer is received by and mates with said housing case to electrically connect said resistor element to said resistance measuring means, wherein a resistance value of said resistor element embedded in said wafer of said container is measured by said resistance measuring means of said housing case so that said container is identified, and wherein said drive means is only activated when said container is identified as an authorized container based on said resistance value of said resistor element.

7. The dispenser apparatus as set forth in claim 6, wherein said wafer attached to said container has two cut-off edge portions to form two straight edges that fit into the housing case.

8. The dispenser apparatus as set forth in claim 5, wherein said detector means includes a first inductive coil, wherein said wafer has a second inductive coil embedded therein and a capacitor connected to said second inductive coil, wherein a resonant frequency is established by said capacitor so that said container is identified, and wherein said drive means is only activated when said container is identified as an authorized container based on said resonant frequency.

9. The dispenser apparatus as set forth in claim 8, wherein said wafer attached to said container has two cut-off edge portions to form two straight edges that fit into the housing case.

10. The dispenser apparatus as set forth in claim 5, further comprising:

wherein said detector means includes a first magnet-sensor pair containing a first magnet and a corresponding first sensor, and a second magnet-sensor pair containing a second magnet and a corresponding second sensor, wherein said wafer has a magnetic element embedded therein to route magnetic flux from said first magnet to said first sensor while said second sensor is inactive, and logic means for detecting when each sensor is activated, wherein said drive means is only activated when said first sensor is activated to identify said container as an authorized container.

11. The dispenser apparatus as set forth in claim 10, wherein said wafer attached to said container has two cut-off edge portions to form two straight edges that fit into said housing case.

12. The dispenser apparatus as set forth in claim 10, wherein said magnetic element is comprised of iron.

13. The dispenser apparatus as set forth in claim 5, further comprising:

binary decoder means, wherein said detector means includes a plurality of sensors electrically connected to said binary decoder means, wherein said wafer has one or more magnets placed thereon, wherein said one or more magnets are geometrically arranged with respect to said plurality of sensors in order to provide a binary code to be fed to said binary decoder means, wherein said binary code is identified by said binary decoder means of said housing case, and wherein said drive means is only activated when said binary code is identified as an authorized binary code.

14. The dispenser apparatus as set forth in claim 13, wherein said wafer attached to said container has two cut-off edge portions to form two straight edges that fit into said housing case.

15. The dispenser apparatus as set forth in claim 5, wherein said chute is made of electrically conductive rubber, wherein said detector means includes resistance measuring means, wherein a resistance value of said chute is measured by said resistance measuring means of said housing case so that said container is identified, and wherein said drive means is only activated when said container is identified as an authorized container based on said resistance value of said chute portion.

16. The dispenser apparatus as set forth in claim 5, wherein said detector means includes a light emitting diode and one or more photoelectric sensors, wherein said wafer has fiber optics located thereon, wherein light is conducted from said light emitting diode to one of said photoelectric sensors by said fiber optics so that a location of one of said photoelectric sensors on said housing case is identified, and wherein said drive means is only activated when said container is identified as an authorized container based on an indentification of one of said photoelectric sensors.

* * * * *